US008003143B2

(12) United States Patent
Taylor

(10) Patent No.: US 8,003,143 B2
(45) Date of Patent: Aug. 23, 2011

(54) PROCESS AND APPARATUS FOR FILLING A CONTAINER WITH FOOD ARTICLES

(75) Inventor: Robert Taylor, Wavre (BE)

(73) Assignee: L'Air Liquide Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 538 days.

(21) Appl. No.: 12/093,831

(22) PCT Filed: Nov. 8, 2006

(86) PCT No.: PCT/EP2006/068213

§ 371 (c)(1),
(2), (4) Date: May 15, 2008

(87) PCT Pub. No.: WO2007/057331

PCT Pub. Date: May 24, 2007

(65) Prior Publication Data

US 2008/0274244 A1 Nov. 6, 2008

(30) Foreign Application Priority Data

Nov. 15, 2005 (EP) ..... 05300924

(51) Int. Cl.
*A23B 4/09* (2006.01)

(52) U.S. Cl. ..... 426/231; 426/393; 426/524; 62/1; 62/64; 414/295; 414/296; 222/54; 222/55; 222/77; 222/146.6; 222/408; 222/415

(58) Field of Classification Search ..... 426/231, 426/524, 393, 129; 221/13, 253, 311; 222/415, 222/54, 55, 77, 146.6, 408, 160; 414/295, 414/296; 62/1, 56, 64
See application file for complete search history.

(56) References Cited

U.S. PATENT DOCUMENTS 3,055,519 A * 9/1962 Hollyday ..... 414/335
(Continued)

FOREIGN PATENT DOCUMENTS

DE 89 09 823 10/1989
(Continued)

*Primary Examiner* — Drew E Becker
(74) *Attorney, Agent, or Firm* — Christopher J. Cronin

(57) ABSTRACT

The invention concerns a process respectively an apparatus for filling a container with articles such as food, in particular meat, and a process respectively an apparatus for cooling articles and is characterised by repeating the following steps: (A) a first portion of the articles is conveyed with a conveying means, in particular a conveyor belt, having a conveyor outlet and is discharged into a container at a lower conveying speed such that a first portion accumulates in the container at the first location closer to the conveyor outlet; and (B) thereafter, a second portion of the articles is conveyed by the conveying means and is discharged into a container at a higher conveying speed, such that the second portion accumulates in the container at the second location further away from the conveyor outlet; as well as a process respectively an apparatus for cooling articles using said process and said apparatus for filling; as well as the articles processed by said processes respectively said apparatus. The control of the conveying speed allows for reducing the number of necessary surfaces of machinery with which the articles come into contact. The invention effects that the articles may be handled more easily in a clean way without the expense of non-uniform filling of the container. The process and the apparatus is particularly suited for homogenously and efficiently cooling articles using carbon dioxide particles.

17 Claims, 1 Drawing Sheet

U.S. PATENT DOCUMENTS

| | | | | | |
|---|---|---|---|---|---|
| 3,090,477 | A | * | 5/1963 | Luek et al. | 198/624 |
| 3,342,309 | A | * | 9/1967 | Hollyday | 198/641 |
| 3,550,746 | A | * | 12/1970 | Juul et al. | 414/389 |
| 3,715,041 | A | * | 2/1973 | Peters | 414/296 |
| 3,785,513 | A | * | 1/1974 | Kitzinger et al. | 414/193 |
| 3,987,890 | A | * | 10/1976 | Merritt | 198/316.1 |
| 3,996,723 | A | | 12/1976 | Greenwell et al. | |
| 4,060,998 | A | * | 12/1977 | Bernard | 62/320 |
| 4,166,364 | A | * | 9/1979 | Ruprecht et al. | 62/384 |
| 4,195,744 | A | * | 4/1980 | Christianson | 220/1.5 |
| 4,287,719 | A | * | 9/1981 | Students | 62/603 |
| 4,352,623 | A | * | 10/1982 | Smiley | 414/294 |
| 4,652,287 | A | * | 3/1987 | Allen et al. | 62/603 |
| 4,687,672 | A | * | 8/1987 | Vitkovsky | 426/524 |
| 4,820,108 | A | * | 4/1989 | Kneer | 414/301 |
| 5,280,813 | A | * | 1/1994 | Jackson | 141/4 |
| 5,351,495 | A | | 10/1994 | Lermuzeaux | |
| 5,421,379 | A | * | 6/1995 | Geiser | 141/1 |
| 5,588,285 | A | | 12/1996 | Odenthal et al. | |
| 6,497,106 | B2 | * | 12/2002 | Lang et al. | 62/63 |
| 2003/0062096 | A1 | * | 4/2003 | Zaun et al. | 141/231 |

FOREIGN PATENT DOCUMENTS

| | | |
|---|---|---|
| EP | 0 632 966 | 1/1995 |
| WO | WO 93/14358 | 7/1993 |

* cited by examiner

PROCESS AND APPARATUS FOR FILLING A CONTAINER WITH FOOD ARTICLES

CROSS-REFERENCE TO RELATED APPLICATIONS

This application is a §371 of International PCT Application PCT/EP2006/068213, filed Nov. 8, 2006.

BACKGROUND

The invention concerns a process respectively an apparatus for filling a container with articles such as food, in particular meat.

In the food industry it is frequently necessary to temporarily store food materials as an intermediate stage in the processing such as for transfer from one processing station to another or to create a buffer storage for food material to ensure that the material is continuously available at processing sites in order to achieve a smooth operation of the process.

In some cases it is advantageous or necessary to use this storage period to effect additional cooling of the material. Specifically for meat processing when meat is de-boned prior to further processing, during the de-boning process the meat reaches a temperature that is warmer than the optimum temperature for storage and it is stored in large transport boxes or bins in which the product can not be effectively cooled by storing the bin in a chilled environment as the heat transfer within the material is much too slow and ineffective.

It is well established to mix a food grade cooling medium with the product to be cooled such as to use solid carbon dioxide particles in form of preformed pellets or as carbon dioxide snow. The cooling medium is brought into contact with the product in order to achieve sufficient or additional cooling of the material. This may be effected by the manual addition of the carbon dioxide by means of adding pellets or by depositing carbon dioxide snow onto the product using "snow horns" in which the carbon dioxide snow is generated on site.

The cooling process may also be automated by means of a cooling device such as the one described in WO 93/14358. According to WO 93/14358 the food article is frozen by contacting the article with a surface of a porous support which is impregnated with a cryogenic liquid, wherein the porous support may be formed as conveyor which is insulated by means of an enclosure.

In the food industry it is highly desirable to minimize the contact of the food products with machinery. For example, any food particles trapped in a mechanism of the machinery may lead to microbiological spoilage and contamination of the food product. It is thus desirable to design food processing equipment to have as few food contact surfaces as possible and to ensure that these are as simple and easy to clean as possible.

EP 0 632 966 A1 discloses an apparatus and method for chilling a food product which includes a food distribution device having a pair of circular members including at least one spaced-apart partition defining a food receiving area; the circular members rotate to cause food delivered to the food product proceeding area to fall into a food storage compartment in a uniform manner; and a cryogen releasing device is connected to one of the circular members which uniformly distributes a cryogenic substance to the food product within the food storage compartment.

It is an object of the present invention to provide a process respectively an apparatus for filling a container with articles such as food, wherein the articles come into contact with surfaces of the machinery as little as possible in order to provide for easy cleanability of the machinery at the condition that full flexibility for efficient cooling of the articles is maintained. It is a further object to provide for articles that have been cooled efficiently, homogenously and in an inexpensive way.

SUMMARY

The invention includes both methods and apparatus to achieve the desired results, as described, but is not limited to the various embodiments disclosed.

These problems are solved according to the invention by the process respectively apparatus for filling a container with articles and by the articles as defined in the main claims. Further advantageous embodiments and favourable developments, which can be applied individually or in any desired suitable combination, are subject of the respective depending claims.

According to the invention, the process for filling a container with articles such as food, in particular meat, is characterized by repeating the following steps: (A) a first portion of the articles is conveyed with a conveying means, in particular a conveyor belt, having a conveyor outlet and is discharged into a container at a lower conveying speed, such that the first portion accumulates in the container at a first location closer to the conveyor outlet; and (B) thereafter, a second portion of the articles is conveyed on the conveying means and is discharged into the container at a higher conveying speed, such that the second portion accumulates in the container at a second location further away from the conveyor outlet.

By using at least two different conveying speeds the articles are thrown respectively dropped to corresponding different locations within the container such that the container may be filled in a uniform manner. The trajectory of articles is determined by the discharge velocity vector of the respective articles at the conveyor outlet. Further contact surfaces for distributing the articles in the container such as the surfaces of a rotating fan as described in the prior art are unnecessary.

In a modification of the invention the articles may be conveyed by a pivoting conveying means. The conveyor outlet of the conveying means may be movable sideways in order to deliver the articles into the container in a uniform manner. In this case the conveyor outlet reciprocates from one side to the other of the container. A pivoting conveying means uses a hinge and at least two electro-motors.

The articles are supplied to the container by means of the variable speed conveyor which is normally set to operate at two speeds. At low speeds the articles are dropped into the container in an area proximate to the conveyor outlet, i.e. at the first location. At high speeds the articles follow a trajectory and are thrown into the container in an area distal to the conveyor outlet, i.e. at the second location.

Once a first pile accumulating at the first location rises above a certain level, the lower conveying speed is increased to the higher conveying speed such that the articles accumulate in a second pile at the second location. Thereafter the second gradually becomes larger and larger. When the second pile exceeds a certain pre-determined limit the conveying speeds is changed to the lower conveying speed again. The conveying speeds respectively the locations where the articles accumulate are repeatedly changed such that the container is filled in a uniform manner.

Uniform filling is also possible for the case that the articles enter the conveying means in an irregular way or in batches, which is common in food production, where a quasi continuous product flow may be interrupted sometimes for a couple of minutes.

The conveying means may be a conveyor belt onto which the articles may be delivered using a vibrating trough.

The articles may be bulk goods such as ground meat or non bulk goods such as meat pieces. The process for filling the container according to the invention applies in particular to filling food articles, for which purpose special care needs to be taken with respect to the machinery and process conditions in order not to introduce sources of contaminations.

Advantageously, the temperature of the articles ranges in between +0° C. and +14° C., preferably between +0° C. and +4° C. The temperatures also may be below freezing point, in particular in between −30° C. and −2° C., in particular in between −25° C. and −18° C.

According to an embodiment of the invention the conveying speed is repeatedly adjusted between at least three different speed levels in particular the conveying speed is repeatedly varied continuously within a range of speed levels. By using more than two speed levels it is possible to define more than two locations within the container at which the articles accumulate. With the help of a suitable conveying speed temporal profile, in particular large containers may be filled in a uniform manner.

Advantageously, the conveying speed is controlled in response to the amount of articles being conveyed and/or being accumulated in the container. This feedback allows for uniform filling of the container.

A mass distribution of the articles within the container may be quantified using at least two individual sensors at the container and the conveying speed may be controlled in response to the quantified estimated mass distribution, in particular an asymmetric weight profile of the container is used for controlling the conveying speed. For example the container that rests on the ground with at least three, in particular four, legs respectively wheels, is put on (at least) two weight sensors that measure the different weights of the legs. The weight difference is used as information about how the container is filled with articles and an asymmetry of the filling of the container may be detected. This information may be used for driving the conveying means for choosing a suitable conveying speed such that the container is filled uniformly respectively an asymmetry of the filling is reduced. The mass distribution may also be quantified using a single, more complex sensor, such as a camera (CCD) or (possibly in conjunction with the use of a camera) using angled laser beams.

At least one supply port for supplying cooling medium may be controllable such that the cooling medium is repeatedly added to the first location and the second location, in particular together with the articles. The cooling medium may also be added anti-cyclically that means in an alternating way to a location different to where the articles accumulate in order to create layers of cooling medium and layers of articles.

The articles may be dispersed in the container, in particular may be dispersed sideways, using a deflection surface in particular a deflection surface at or above the container. The deflection surface divides the flow of articles into two parts or spreads the flow of articles such that uniform filling of the contained is achieved. The deflection surface may be fixed to the container or may be fixed to the machine frame which is carries the conveying means.

According to the invention, the process for cooling articles such as food, in particular meat, is characterised by the process for filling according to the invention, wherein repeatedly, (A) a first portion of the articles is conveyed with a conveying means, in particular a conveyor belt, having a conveyor outlet and is discharged into a container at a lower conveying speed, such that the first portion accumulates in the container at the first location closer to the conveyor outlet, and (B) thereafter a second portion of the articles is conveyed with the conveying means and discharged into the container at a higher conveying speed such that the second portion accumulates in the container in the second location further away from the conveyor outlet, wherein a cooling medium, in particular liquid nitrogen or carbon dioxide particles, is added into the container. The use of carbon dioxide particles is preferred.

With help of this process the articles may be cooled uniformly in an efficient and comparatively inexpensive way without much contact to surfaces of the machinery. The cooling medium may be cold air, liquid nitrogen or carbon dioxide particles. For the case that cold air or liquid nitrogen is used a means of creating convective heat transfer, in particular a fan, is advantageous. The carbon dioxide particles may be in form of snow or in form of pellets having a diameter ranging from 1 mm to 10 mm, in particular ranging from 2 mm to 5 mm.

The cooling medium may be added into the container to come into close contact with the articles, they may also be added to the articles by means of the conveying means, in particular by discharge onto the conveyor belt.

The cooling medium is preferably food grade.

The cooling medium may be repeatedly added at the first and the second location, in particular together and simultaneously with the articles. By adding the cooling medium anti-cyclically, i.e. the cooling medium is added at the one location while the articles accumulate at the other location, the cooling medium and the articles are formed in layers.

The amount of added cooling medium may be controlled in response to the amount and/or the temperature of the articles being conveyed. For example if the articles are too warm, more cooling medium may be added, in order to cool the articles down to the desired temperature.

The amount of added cooling medium may be controlled in response to the temperature of the articles and/or respectively temperature distribution of the articles within the container. For example whenever a temperature sensor notices that the temperature somewhere in the container exceeds a predetermined level, a suitable amount of cooling medium is added to this location. The temperature sensors may operate mechanically, electronically or optically.

According to the invention the apparatus for filling a container with articles such as food, in particular meat, comprises: the container with a receiving opening for receiving the articles, a conveying means, in particular a conveyor belt, for conveying the articles, the conveying means having a conveyor outlet and a conveyor outlet being arranged in relation to the receiving opening such that the articles discharged from the conveyor outlet enter into the container, wherein for uniformly filling the container, the conveying means is operable at least two different conveying speeds such that, at a lower conveying speed, a first portion of the articles accumulates in the container at a first location closer to the conveyor outlet and, at a higher conveying speed, a second portion of the articles accumulates in the container at a second location further away from the conveyor outlet.

By choosing a suitable conveying speed the container may be filled in a uniform manner without the use of complicated distributing or dispersing means or complicated mechanical drives. The articles come into contact with only a few surfaces of the machinery such that the machinery may be cleaned more easily. The surfaces with which the articles come into contact may be designed to be smooth with as few gaps as possible, simple and easy to clean.

The conveying means may be operable at more than two conveying speeds, in particular the conveying speed is repeatedly available continuously within a range of different speed levels. Continuously in this respect means that the conveying speed is varied smoothly without abrupt changes, wherein the time base of the term "abrupt" is the general periodicity with which the conveying speed is changed within the range of different speed levels. The temporal profile of the conveying speed may be chosen such that the articles, which may arrive in a discontinuous or intermittent manner at the outlet of the conveying means, are nevertheless filled into the container such that a uniform mass distribution within the container is achieved.

Preferably a control unit for controlling uniform filling in the container is provided. The conveying means may be controlled in response to the amount of articles arriving at the conveyor outlet respectively the amount of the articles that are already discharged into the container.

Preferably, at least two sensors are provided in, at or below the container in particular separately from the container, in order to estimate the mass distribution of the articles within the container and that the conveying speed is controllable in response to the estimated mass distribution.

The mass distribution of the articles within the container may be quantified using two weight sensors that measure an asymmetric load of the container e.g. by measuring the difference in weight of the respective support feet or support wheels of the container. An asymmetric weight profile of the container may be used for controlling the conveying speed. For instance if the container comprises four wheels (the wheels for rolling the container over ground) the weight of the two wheels close to the conveyor outlet, i.e. the weight of the proximate wheels, is compared with the weight of the two wheels opposite to the conveyor outlet, i.e. the weight of the distal wheels, and the difference is used as measure for driving the conveying means. By choosing suitable conveying speeds uniform filling of the container is achieved.

The sensor for quantifying a mass distribution may work mechanically, electronically or optically. For example strain gauges or a CCD camera may be used.

The apparatus may comprise a deflection surface at the receiving opening of the container, in particular a deflection surface separate from the container, for dispersing the articles, in particular sideways, in the container. The deflection surface has a simple geometry in order to be cleaned easily. It may be fixed to the container.

According to the invention, the apparatus for cooling articles such as food, in particular meat, is characterised in that the apparatus for filling a container according to the invention is provided, wherein the apparatus for cooling articles further comprises a container with a receiving opening for receiving the articles, a conveying means, in particular an conveyor belt, for conveying the articles, the conveying means having a conveying outlet and the conveyor outlet being arranged in relation to the receiving opening such that the articles having been discharged from the conveyor outlet accumulate in the container, wherein for uniformly filling the container, the conveying means is operable at least two different conveying speeds such that, at a lower conveying speed, a first portion of the articles accumulates in the container at the first location closer to the conveyor outlet and, at a higher conveying speed, a second portion of the articles accumulates in the container at a second location further way for the conveyor outlet, and further comprises at least one supply port, preferably at least two supply ports, for supplying a cooling medium into the container, in particular carbon dioxide particles. In special cases liquid nitrogen may be supplied instead of carbon dioxide particles.

By suitably varying respectively adjusting the conveying speed, the container may be filled uniformly even for the case that the articles are not supplied continuously and smoothly to the conveying means. The apparatus may comprise control means for controlling the supply of cooling medium.

Depending on the temperature and/or the amount of the articles to be cooled, the amount of cooling medium may be precisely metered and adjusted.

Furthermore, the cooling medium may be added at locations within the container in response to the temperature profile within the container. The amount of added cooling medium may be controllable in response to the amount of articles being conveyed.

Preferably at least one temperature sensor, preferably multiple temperature sensors, are provided for the determining the temperature respectively the temperature distribution of the articles. The Temperature respectively the temperature distribution may be determined of the articles on or in the conveying means and/or of the articles in the container. The amount of the cooling medium may be controllable in response to the temperature respectively temperature distribution.

The amount of cooling medium to be added may be controllable in response to the temperature of the articles, in particular in temperature of the articles being conveyed, and/or the respectively temperature distribution of the articles with the container.

The articles according to the invention are cooled with the process for cooling according to the invention and/or are cooled with the apparatus for cooling according to the invention. The articles may be chilled or at least partially frozen goods. The advantages and technical effects of the invention as described above provide for articles with particular properties with respect to their quality and product homogeneity, which result from the achievable high purity level and the well defined cooling conditions of the system.

BRIEF DESCRIPTION OF THE DRAWINGS

Further advantages and details, which may be applied individually or may be combined in any desired and suitable form, will be explained with respect to the following drawings, which shall not restrict but only exemplarily illustrate the invention.

DESCRIPTION OF PREFERRED EMBODIMENTS

Figure 1:
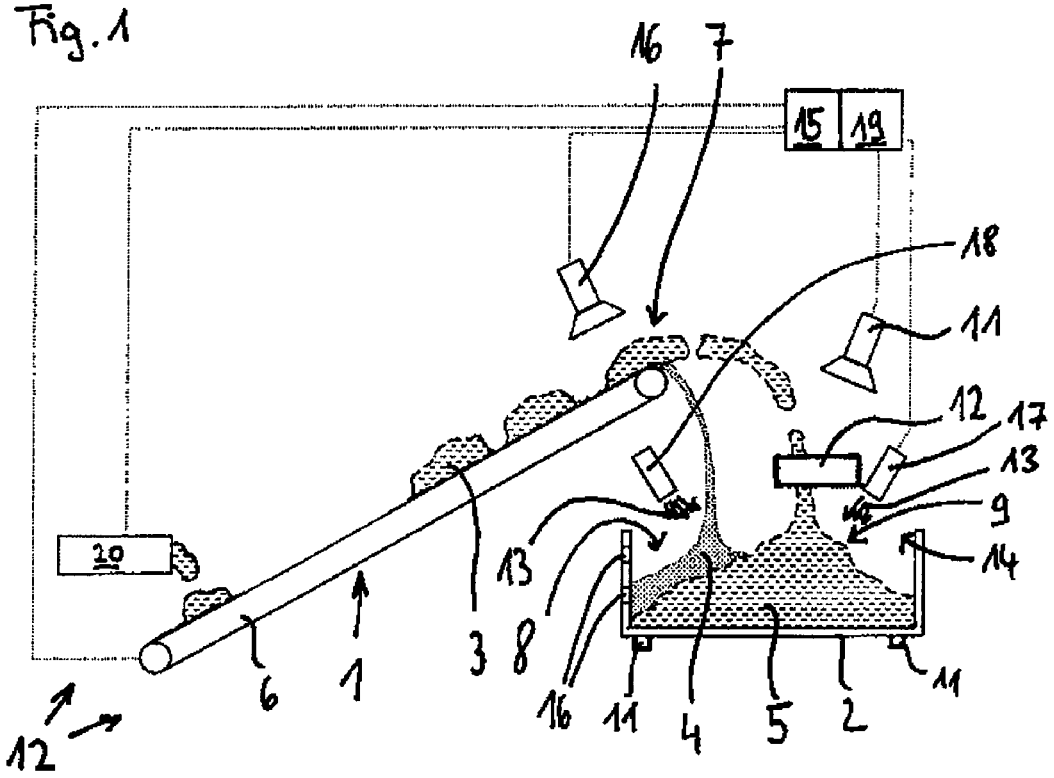
FIG. 1 schematically shows the apparatus for cooling according to the invention from a lateral view.

FIG. 1 schematically shows the apparatus 10 for cooling articles 3 according to the invention from a lateral view. Articles supplied by a vibrating trough 20 of a production line (not shown) are supplied onto a conveying means 6 which is provided as conveying belt. The articles 3 are pieces of meat such as de-boned chicken meat, which enter the conveying means 6 in a discontinuous manner and with interruptions. The interruptions may last up to a couple of minutes. The temperature of the articles 3 on the conveying belt may be about 8° C.

The articles 3 are conveyed at a conveying speed and are discharged at a conveyor outlet 7 into a container 2 such that the articles 3 accumulate at a first location 8. If the articles 3 are conveyed with a higher conveying speed, the articles 3 follow a trajectory and pile up at a second location 9 in the container 2 which is further away from the conveyor outlet 7 than the first location 8. Thus the lower conveying speed leads to a first pile proximate at the conveyor outlet 7 and the higher conveying speed leads to a second pile distal to the conveyor outlet 7. A first portion 4 of the articles 3 accumulate at the first location 8, and a second portion 5 of the articles 3 accumulate at the second location 9. The portions 4, 5 accumulate in piles within the container 2 wherein the natural angle of the respective piles depends on the kind of articles 3. For meat above freezing point this natural angle is approximately 30° to 40°.

Weight sensors 11 measure the weight of the container 2. As the weight sensors 11 are located at different places at the container 2, it is possible to estimate the mass distribution of the articles 3 in the container 2 and it is possible to estimate the degree of asymmetry of the filling. If the measured weight difference exceeds a predetermined value, the conveying speed of the conveying means 6 is suitably changed by a control unit 15. Articles 3 are piled up at a location within the container 2 where too few articles are present. This helps to remove the asymmetry of the mass distribution within the container. The sensors 11 may be fixed to the container 2 but may as well be provided at the machine frame (not shown). For quantifying the mass distribution within the container 2 the sensors 11 may operate mechanically, electronically or optically.

A first supply port 17 and a second supply port 18 which are provided as "snow horns" supply cooling medium 13 in form of carbon dioxide pellets into the container 2. The supply ports 17, 18 are fixed to the machine frame (not shown). The amount of cooling medium 13 supplied by the two supply ports 17, 18 is controlled by a control means 19 which may take into account the amount of articles 3 being conveyed by the conveying means 6 or the amount of articles 3 in the container 2. The control means 19 controls the supply of cooling medium 13 in response to the temperature either of the articles 3 on the conveying means 6 or of the articles 3 within the container 2 for which purpose temperature sensors 16 are used. The temperature sensors 16 either work mechanically, electronically or optically either by contact or contact-free. The articles 3 are cooled to a temperature of approximately 2° C. to 3° C.

The articles 3 are discharged into the container 2 through a receiving opening 14. In order to disperse the articles 3 within the container 2 a simple deflection surface 12 is fixed to the container 2 in order to distribute the articles 3 sideways and to facilitate uniform filling within the container 2. The conveying means 6 in combination with the container 2 and the control unit 15 for controlling the conveying speed forms an apparatus for filling 1 which allows for uniformly filling the container 2 even for the case that the articles 3 enter the apparatus 1 discontinuously or with considerable fluctuations. By means of the apparatus 1 for filling respectively the apparatus 10 for cooling the articles 3 can be treated in a gentle and clean way as the articles 3 come into contact with only a few surfaces such that the risk of contaminations due to difficulties of cleaning the apparatus is reduced.

Figure 2:
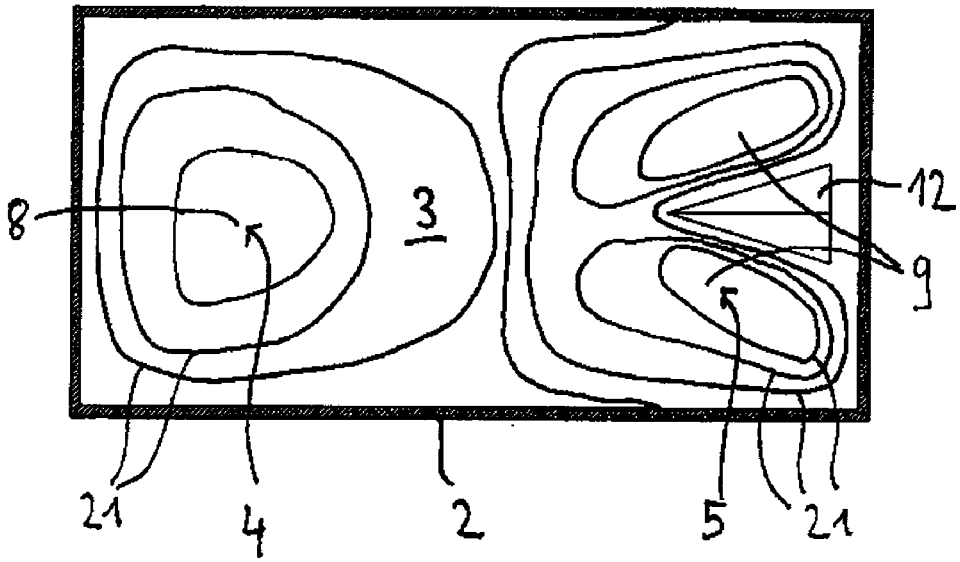
FIG. 2 shows the container according to FIG. 1 in a view from above.

FIG. 2 shows the container 2 according to FIG. 1 in the top view where the distribution of the articles 3 is illustrated using contour lines 21. As can be clearly seen the first portion 4 corresponding to the lower conveying speed accumulates as a first pile at the first location 8 and the second portion 5 accumulates as a second pile at the second location 9. The second pile at the second location 9 is split up into a double pile due to the use of the deflection surface 12. The deflection surface 12 helps to transfer the articles 3 into the remote corners of the container 2.

The invention concerns a process respectively an apparatus for filling a container 2 with articles 3 such as food, in particular meat, and a process respectively an apparatus for cooling articles 3 and is characterised by repeating the following steps: (A) a first portion 4 of the articles 3 is conveyed with a conveying means 6, in particular a conveyor belt, having a conveyor outlet 7 and is discharged into a container 2 at a lower conveying speed such that a first portion 4 accumulates in the container 2 at the first location 8 closer to the conveyor outlet 7; and (B) thereafter, a second portion 5 of the articles 3 is conveyed by the conveying means 6 and is discharged into a container 2 at a higher conveying speed, such that the second portion 5 accumulates in the container 2 at the second location 9 further away from the conveyor outlet 7; as well as a process respectively an apparatus for cooling articles 3 using said process and said apparatus for filling; as well as the articles processed by said processes respectively said apparatus. The control of the conveying speed allows for reducing the number of necessary surfaces of machinery with which the articles 3 come into contact. The invention effects that the articles 3 may be handled more easily in a clean way without the expense of non-uniform filling of the container. The process and the apparatus is particularly suited for homogenously and efficiently cooling articles using carbon dioxide particles.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

REFERENCE NUMERALS

1 apparatus for filling
2 container
3 articles
4 first portion
5 second portion
6 conveying means
7 conveyor outlet
8 first location
9 second location
10 apparatus for cooling
11 sensors
12 deflection surface
13 cooling medium
14 receiving opening
15 control unit
16 temperature sensor
17 first supply port
18 second supply port
19 control means
20 vibrating trough
21 contour lines

What is claimed is:

1. A process for filling a container with food characterized by repeating the following steps:

(A) a first portion of the food articles is conveyed with a conveying element having a conveyor outlet and is discharged into the container at a lower conveying speed, such that the first portion accumulates in the container at a first location closer to the conveyor outlet;

(B) thereafter, a second portion of the food articles is conveyed on the conveying element and is discharged into the container at a higher conveying speed, such that the second portion accumulates in the container at a second location further away from the conveyor outlet; and (C) adding a cooling medium to the container, the cooling medium selected from the group of liquid nitrogen and solid carbon dioxide, wherein the cooling medium is added to the container either by:

(1) adding the cooling medium to the first location when the first portion of articles are accumulating at the first location and adding cooling medium to the second location when the second portion of articles are accumulating at the second location; or (2) adding the cooling medium to the first location when the second portion of articles are accumulating at the second location and adding the cooling medium to the second location when the first portion of articles are accumulating at the first location.

2. The process of claim 1, wherein the conveying speed is repeatedly adjusted between at least 3 different speed levels.

3. The process of claim 1, wherein the conveying speed is controlled in response to the amount of articles being conveyed and/or being accumulated in the container.

4. The process of claim 1, wherein the articles are dispersed in the container using a deflection surface disposed at or above the container.

5. The process of claim 4, wherein the articles are dispersed sideways using the deflection surface.

6. The process of claim 5, wherein the deflection surface is at or above the container.

7. The process of claim 1, wherein the cooling medium is to the first location when the first portion of articles are accumulating at the first location and adding cooling medium to the second location when the second portion of articles are accumulating at the second location.

8. The process of claim 1, wherein the amount of added cooling medium is controlled in response to the amount and/or the temperature of the articles being conveyed.

9. The process of claim 1, wherein the amount of added cooling medium is controlled in response to the temperature of the articles and/or respective temperature distribution of the articles within the container.

10. The process of claim 1, wherein the food is meat.

11. The process of claim 1, wherein the conveying element comprises a conveyor belt.

12. The process of claim 1, wherein the conveying speed is repeatedly varied continuously within a range of speed levels.

13. The process of claim 1, wherein the cooling medium is liquid nitrogen.

14. The process of claim 1, wherein the cooling medium is solid carbon dioxide.

15. The process of claim 1, wherein the cooling medium is to the second location when the first portion of articles are accumulating at the first location and adding cooling medium to the first location when the second portion of articles are accumulating at the second location.

16. A process for filling a container with food characterized by repeating the following steps:

(A) a first portion of the articles is conveyed with a conveying element having a conveyor outlet and is discharged into the container at a lower conveying speed, such that the first portion accumulates in the container at a first location closer to the conveyor outlet; and (B) thereafter, a second portion of the articles is conveyed on the conveying element and is discharged into the container at a higher conveying speed, such that the second portion accumulates in the container at a second location further away from the conveyor outlet, wherein a mass distribution of the articles within the container is quantified using at least two sensors at the container and the conveying speed is controlled in response to the quantified estimated mass distribution.

17. The process of claim 16, wherein the conveying speed is controlled in response to an asymmetric weight profile of the container is used for controlling the conveying speed.

* * * * *